United States Patent [19]

Fiala

[11] 4,383,514

[45] May 17, 1983

[54] ARRANGEMENT FOR FUEL SUPPLY TO THE COMBUSTION CHAMBERS OF A VEHICLE INTERNAL COMBUSTION ENGINE WITH ENGINE BRAKING DISCONNECTION

[75] Inventor: Ernst Fiala, Wolfsburg, Fed. Rep. of Germany

[73] Assignee: Volkswagenwerk Aktiengesellschaft, Wolfsburg, Fed. Rep. of Germany

[21] Appl. No.: 191,126

[22] Filed: Sep. 26, 1980

[30] Foreign Application Priority Data

Oct. 19, 1979 [DE] Fed. Rep. of Germany ..... 2942319

[51] Int. Cl.[3] ..... F02D 13/06; F02B 75/12; F02D 17/00; F02D 5/00

[52] U.S. Cl. ..... 123/481; 123/198 F; 123/478; 123/493

[58] Field of Search ..... 123/481, 198 F, 478, 123/493, 59 EC

[56] References Cited

U.S. PATENT DOCUMENTS

| | | | |
|---|---|---|---|
| 2,875,742 | 3/1959 | Dolza | 123/481 |
| 3,763,833 | 10/1973 | Rachel | 123/478 |
| 4,024,850 | 5/1977 | Peter et al. | 123/198 F |
| 4,144,804 | 3/1979 | Kato et al. | 123/481 |
| 4,153,033 | 5/1979 | Iizuka | 123/481 |
| 4,165,610 | 8/1979 | Iizuka et al. | 123/481 |
| 4,237,832 | 12/1980 | Hartig et al. | 123/59 EC |
| 4,274,382 | 6/1981 | Sugasawa et al. | 123/198 F |
| 4,276,863 | 7/1981 | Sugasawa et al. | 123/198 F |

*Primary Examiner*—Raymond A. Nelli
*Attorney, Agent, or Firm*—Brumbaugh, Graves, Donohue & Raymond

[57] ABSTRACT

Arrangement for fuel supply to the combustion chambers of a vehicle internal combustion engine with an engine-braking disconnection. A sensor determines the rotational speed of the engine. Function generators determine the limit value signals which are a function of the rotational speed of the engine. Comparators compare the signals determined by the function generators with a load signal received from a potentiometer acting as a position sensor indicating the position of the intake manifold throttle valve. The comparators are connected to switches which regulate or eliminate the fuel supply to the combustion chamber depending upon the output of the said comparators by supplying fuel to all combustion chambers, to groups of combustion chambers, or to no combustion chambers, so that the operation of the engine is fuel-consumption optimal.

5 Claims, 2 Drawing Figures

ARRANGEMENT FOR FUEL SUPPLY TO THE COMBUSTION CHAMBERS OF A VEHICLE INTERNAL COMBUSTION ENGINE WITH ENGINE BRAKING DISCONNECTION

BACKGROUND OF THE INVENTION

This invention relates to an arrangement for fuel supply to the combustion chambers of a vehicle internal combustion engine with an engine braking disconnection. More particularly, the invention relates to a fuel supply arrangement that supplies fuel to all, less than all, or none of an engine's combustion chambers based on engine speed and load.

The invention is an improvement in the fuel supply arrangements known from:

Offenlegungsschrift No. 22 55 350

Offenlegungsschrift No. 26 12 172

Offenlegungsschrift No. 27 24 487

The arrangement known from Offenlegungsschrift No. 22 55 350 contains two devices which operate separately, although the two devices are structurally connected. One device causes a reduction in the fuel supply, and finally an elimination of the fuel supply, to fuel injection nozzles following the return of the accelerator pedal to its rest position. The second device is controlled by a microswitch located near the accelerator pedal which elminates the fuel supply to individual combustion chambers or groups of combustion chambers during idling and operation of the engine under small engine loads.

In view of its division into the above described two devices, this arrangement is complex in construction. Additionally, this arrangement suffers from the disadvantage that the elimination of the fuel supply to individual combustion chambers or groups of combustion chambers, and thus the corresponding resumption of the fuel supply to the chambers, occurs independent of the prevailing rotational speed of the engine, and, rather, at a constant accelerator pedal position, which, due to the arrangement of the microswitch, is fixed in advance. For the above reasons, the arrangement does not operate at optimal consumption conditions. Another disadvantage of this arrangement is the occurence of an undesirable power jump, or "starting jerk," when the fuel supply is connected to or disconnected from the individual combustion chambers or groups of combustion chambers.

To this end, Offenlegungsschrift No. 26 12 172 discloses an improvement in the fuel supply arrangement designed to alleviate this undesirble power jump by providing for the actuation of the intake manifold throttle valve during the connecting/disconnecting operation. However, the coupling between a swivel segment connected on the one hand to the accelerator pedal, and on the other hand to the throttle valve shaft is accomplished in such a manner that the driver is able to operate the vehicle such that defined operating points in the power-rotational speed diagram are attained that are not optimal insofar as fuel consumption is concerned. Additionally, this arrangement does not mention an engine braking disconnecting feature as does the present invention, nor is an engine-braking feature disclosed in the Offenlegungsschrift No. 27 24 487.

In the Offenlegungsschrift No. 27 24 487, the elimination of the fuel supply to individual combustion chambers or groups of combustion chambers occurs as a function of signals received from comparators. The comparators receive signals from function generators which are connected with a rotational speed sensor and compare these signals with a load signal, the load signal being a function of the negative pressure in the intake manifold of the engine. In this case it is possible to provide rotational speed-dependent transitions between engine operation with all combustion chambers, or with only individual or groups of combustion chambers, in accordance with the several operating ranges in the power vs. rotational speed diagram of the engine, but the load signal is not itself independent of the rotational speed.

BRIEF SUMMARY OF THE INVENTION

It is an object of the invention to improve the fuel supply arrangement to the combustion chambers of a vehicle internal combustion engine by providing for the elimination of the fuel supply to the combustion chambers or groups of combustion chambers, or the connection of the fuel supply to all combustion chambers or groups of combustion chambers, so that the elimination or connection of the fuel supply occurs at preferred consumption conditions.

It is a further object of the invention to improve the fuel supply arrangement so that power jumps, or "starting jerks," can be avoided during the transition from engine-braking to normal engine operation.

The objects just mentioned are attained by providing a fuel supply arrangement that provides fuel to all, some, or none of the combustion chambers of a vehicle internal combustion engine based upon the comparison of (1) limit values that are a function of engine speed, and (2) load or throttle valve position.

Ranges of engine speeds are provided within which the engine is operated optimally with fuel supply to all combustion cylinders, to some combustion cylinders, or to no combustion cylinders. Obviously, the number of ranges of engine speeds will correspond to the number of single cylinders or cylinder groups supplied with fuel individually.

In the preferred embodiment, three ranges of engine speeds are provided. In range I the engine is operated optimally with fuel supply to four cylinders; in range II the engine is operated optimally with fuel supply to two cylinders; in range III the engine is operated optimally without any fuel supply.

Switches are interposed between injection nozzles and an injection regulator that controls the injection nozzles in a known manner. There are provided electronic function generators that determine the throttle valve positions associated with the prevailing rotational speed of the engine, which position signals define the limits of the operating range II in which the engine operates at optimal conditions with two cylinders, the said range II being bounded by curve b, and the abscissa where power $P=0$ as illustrated in FIG. 2. Comparators compare these signals received from the function generators with a signal indicative of engine load. The load signal can be, for example, dependent on position of the throttle valve as indicated by means of a potentiometer connected with the accelerator pedal.

There also is provided in the arrangement a delay element which operates to prevent all four injection valves from connecting in at such a rate as to cause a power jump in the event that the throttle valve is opened quickly. Additionally, a switch is interposed between the comparators and the fuel supply switches to maintain the fuel supply to all combustion chambers (or to defined cylinder groups) under defined conditions, e.g., starting, cold cooling water, operation of the engine in gears 1, 2 and 3, or no actuation of the brake.

Under normal circumstances the load signal determined by the potentiometer is larger than the signals of both function generators, and the arrangement operates in range I, i.e., the switches interposed between the injection nozzles and the injection regulator are closed and all injection nozzles are operating. In the event that the throttle valve is closed the operation of the engine is in range III, i.e., the load signal determined by the potentiometer is smaller than the two signals delivered by the function generators and the switches interposed between the injection valves and the injection regulator are opened, thus eliminating the full supply to all injection valves, unless the switch located between the fuel supply switches and the comparators operates under a defined condition to maintain the fuel supply.

The engine operates in range II if the signal of the function generator which defines the limit curve b is larger than the load signal and at the same time the signal of the function generator which defines the limit curve P=0 is smaller than the load singal, i.e., a switch regulating two of the injection valves will be opened, and the switch regulating the remaining two injection valves will be closed, so that only two of the injection valves will be supplied with fuel.

While the invention is described herein with reference to an internal combustion engine with fuel injection, it should be understood that the invention may also be utilized in internal combustion engines utilizing a different mixture formation, e.g., engines with divided intake manifold throttle valves, engines with independent throttle valves, or diesel engines.

BRIEF DESCRIPTION OF THE DRAWINGS

The above and further advantages of the invention will be better understood with reference to the following detailed description of the preferred embodiment taken in connection with the attached drawings wherein.

DESCRIPTION OF THE PREFERRED EMBODIMENT

Figure 1:
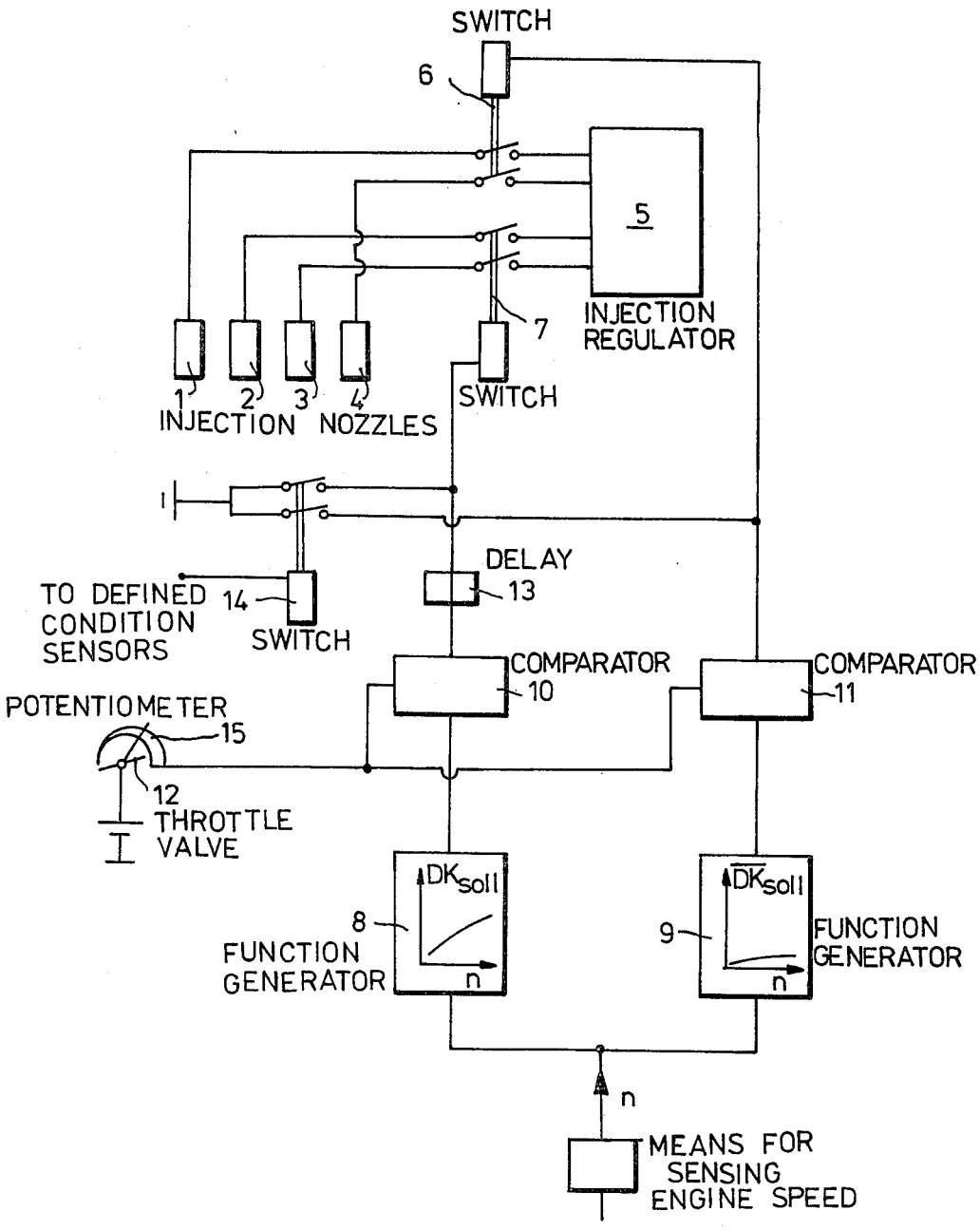
FIG. 1 is an illustration in block diagram of the preferred embodiment of the invention in the form of an electrical system.

In FIG. 1 injection nozzles 1, 2, 3, 4 are controlled in a known manner by an injection regulator 5. Double switches 6, 7 which are arranged between the injection nozzles 1, 2, 3, 4 and the injection regulator 5, are controlled as a function of the position of a throttle valve 12 and the rotational speed n of the engine. The aim of this control is illustrated by reference to FIG. 2, which shows the power (P) versus rotational speed n diagram. Engine operating range I is bounded by curve a and the curve b, and is the engine operation range within which the engine operates at optimal fuel consumption with fuel supply to all four cylinders. Engine operating range II is bounded by curve b and the abscissa where P=0, and is the engine operation range within which the engine operates at optimal fuel consumption with fuel supply to two cylinders. Engine operating range III is bounded by curve c and the abscissa where P=0, and is the engine operation range within which the engine operates at optimal fuel consumption with no fuel supply.

Obviously, in the event the engine is divided into a larger number of single cylinders or cylinder groups supplied individually with fuel, correspondingly more engine operation ranges will be present.

Figure 2:
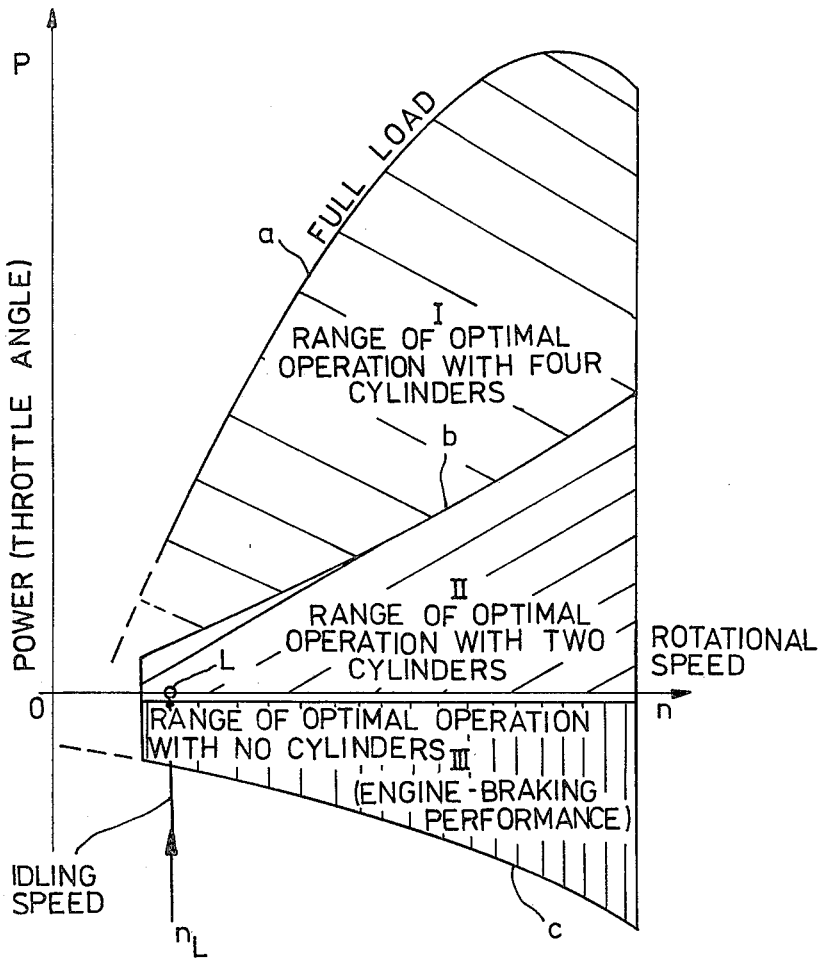
FIG. 2 represents the power rotational speed diagram of the engine.

Idling (point L) takes place generally with less than all the cylinders in operation, and as illustrated in FIG. 2, with two cylinders in operation.

Referring again to FIG. 1, the electronic function generators 8,9 determine the throttle valve positions $DK_{soll\ (prescr.)}$, $\overline{DK}_{soll\ (prescr.)}$ associated with the prevailing rotational speed n of the engine, these positions defining the two limit curves which bound operating range II, said limits being curve b, and the abscissa where P=0 in FIG. 2. Again in FIG. 1, comparators 10, 11 compare the signals $DK_{soll\ (prescr.)}$, $\overline{DK}_{soll\ (prescr.)}$ received from the function generators 8,9 with a load signal which is a function of the position of the throttle valve 12, said load signal being determined by means of a potentiometer 15 which operates as a position sensor.

When the engine is operating as defined by range I in FIG. 2, the load signal determined by the position of the throttle valve 12 is larger than the output signal $\overline{DK}_{soll\ (prescr.)}$ of the electronic function generator 8, thereby closing switch 7; and the load signal determined by the position of the throttle valve 12 is larger than the output signal $DK_{soll\ (prescr.)}$ of the electronic function generator 9, thereby closing switch 6; thus with switches 6, 7 being closed, the fuel supply is provided to all injection valves 1, 2, 3, 4. In the event the throttle valve 12 is opened quickly, a power jump is prevented by operation of a delay element 13 which operates to prevent all four injection valves 1, 2, 3, 4 from connecting in at too fast a rate. Additionally, double switch 14 maintains the fuel supply to all combustion chambers, or to defined combustion chamber groups, under defined operating conditions, e.g., starting, cold cooling water, operating in predetermined gears, or no actuation of the brake.

The operation of the engine as defined by range II in FIG. 2 results when the signal $DK_{soll\ (prescr.)}$ of electronic function generator 8 is larger than the load signal determined by the position of the throttle valve 12, thereby opening switch 7, while at the same time the signal $\overline{DK}_{soll\ (prescr.)}$ is smaller than the said load signal, thereby closing switch 6, thus eliminating fuel supply to injection valves 2, 3 and providing fuel supply to injection valves 1, 4.

In engine braking operation as defined in range III in FIG. 2, the throttle valve 12 is closed so that the load signal determined by the position of the throttle valve 12 is smaller than the two signals $DK_{soll\ (prescr.)}$, $\overline{DK}_{soll\ (prescr.)}$ delivered by the function generators 8, 9, and unless this occurs as a result of a predetermined condition which will activate the double switch 14, switches 6, 7 are opened and the fuel supply to all injection valves 1, 2, 3, 4 is eliminated.

It should be understood that the foregoing disclosure relates only to the preferred embodiment of the invention, and that it is intended to cover all changes and modifications of the embodiment herein chosen for purpose of the disclosure which do not constitute departures from the spirit and scope of the invention set forth in the appended claims.

I claim:

1. In a fuel supply arrangement in an internal combustion engine of a vehicle containing a plurality of combustion chambers with means for the elimination of the fuel supply to all combustion chambers during an engine braking mode and means for the elimination of the fuel supply to less than all combustion chambers during the operation of the engine at a reduced output, the improvement wherein the fuel supply arangement operates to prevent starting jerks when said engine is in transition from said engine braking mode to a power output mode and includes:

(a) means for sensing the rotational speed of the engine;

(b) means for generating at least a first and a second limit value signal as a function of the rotational speed of the engine which limit value signals define at least one intermediate range of engine operation in said power output mode in which the power output of said engine exceeds zero, said first limit value signal defining a boundary between said engine braking mode and said power output mode, and said second limit value signal defining a boundary between a mode in which less than all combustion chambers are supplied with fuel and a mode in which a still greater number of combustion chambers are supplied with fuel, said means for generating limit value signals being connected with said means for sensing the rotational speed of the engine;

(c) means for providing a load signal indicative of engine load;

(d) comparison means for comparing said limit value signals with said load signal;

(e) said comparison means having at least a first and second output connection, (1) said first output connection being in controlling relation with said means for elimination of the fuel supply to less than all said combustion chambers, and (2) said second output connection being in controlling relation to said means for eliminating fuel supply to the remainder of said combustion chambers, said means for eliminating the fuel supply to the remainder of said combustion chambers comprising said means for eliminating the fuel supply to all combustion chambers;

(f) each of said means for elimination and the comparison means being connected such that when said load signal is lower than all of said limit values generated by said means for generating at least two limit values, said engine braking mode is defined and said fuel supply to all combustion chambers is eliminated, and said fuel supply to only some of said combustion chambers is always first restored whenever said load signal is increased to greater than said first limit value signal defining said boundary between said engine braking mode and said power output mode, whereby sudden increased load from engine braking to an acceleration zone requiring all cylinders causes stepwise introduction of some and then all cylinders.

2. The arrangement according to claim 1 wherein the means for generating limit valve signals comprise function generators, said function generators defining ranges of engine operation for efficient fuel consumption with all, less than all, and no chambers supplied with fuel, said comparison means being responsive to the outputs of said function generators to eliminate the supply of fuel to none, less than all, and all chambers based on said ranges of engine operation.

3. The arrangement according to claim 1 wherein the means for the elimination of the fuel supply to less than all combustion chambers comprises switches operable by electrical signals, said switches being connected between an injection regulator and injection valves, said injection valves being associated with said less than all combustion chambers.

4. The arrangement according to claim 1, 2, or 4 wherein a means is provided to prevent the elimination of the fuel supply at defined operating conditions.

5. The arrangement according to claim 4 wherein said means to prevent the elimination of fuel is connected with said means for elimination of fuel to prevent opening thereof by said means for comparing during said defined operating conditions.

* * * * *

UNITED STATES PATENT AND TRADEMARK OFFICE

CERTIFICATE OF CORRECTION

PATENT NO. : 4,383,514

DATED : May 17, 1983

INVENTOR(S) : Ernst Fiala

It is certified that error appears in the above—identified patent and that said Letters Patent is hereby corrected as shown below:

Column 6, line 34, "or 4" should read --or 3--.

Signed and Sealed this

*Sixteenth* Day of *August 1983*

[SEAL]

*Attest:*

GERALD J. MOSSINGHOFF

*Attesting Officer*

*Commissioner of Patents and Trademarks*